US007116291B1

(12) United States Patent
Suzuki et al.

(10) Patent No.: US 7,116,291 B1
(45) Date of Patent: Oct. 3, 2006

(54) IMAGE DISPLAY AND METHOD OF DRIVING IMAGE DISPLAY

(75) Inventors: Mutsumi Suzuki, Kodaira (JP); Toshiaki Kusunoki, Tokorozawa (JP); Makoto Okai, Tokorozawa (JP); Masakazu Sagawa, Inagi (JP); Akitoshi Ishizaka, Chiba (JP)

(73) Assignee: Hitachi, Ltd., Tokyo (JP)

( * ) Notice: Subject to any disclaimer, the term of this patent is extended or adjusted under 35 U.S.C. 154(b) by 519 days.

(21) Appl. No.: 10/031,377

(22) PCT Filed: Sep. 4, 2000

(86) PCT No.: PCT/JP00/05989

§ 371 (c)(1),
(2), (4) Date: Apr. 12, 2002

(87) PCT Pub. No.: WO01/20590

PCT Pub. Date: Mar. 22, 2001

(30) Foreign Application Priority Data

Sep. 9, 1999 (JP) ..... 11/256246

(51) Int. Cl.
*G09G 3/30* (2006.01)

(52) U.S. Cl. ..... 345/76; 345/75.2

(58) Field of Classification Search ..... 345/73, 345/74.1, 75.1, 75.2, 76; 313/169.3, 309, 313/331

See application file for complete search history.

(56) References Cited

U.S. PATENT DOCUMENTS 5,600,343 A 2/1997 Sarrasin
5,912,531 A * 6/1999 Hasegawa et al. ..... 313/495
6,608,620 B1 * 8/2003 Suzuki et al. ..... 345/204
6,873,309 B1 * 3/2005 Suzuki et al. ..... 345/76

FOREIGN PATENT DOCUMENTS

EP 0 597 772 A1 11/1993

(Continued)

OTHER PUBLICATIONS

Kuniyoshi Yukoo, Hiroshi Tanaka, Shinji Sato, Junichi Murota, and Shoichi Ono, "Emission Characteristics of Metal-Oxide-Semiconductor Electron tunneling Cathode", J. Vac. Sci. Technol. B 11(2), Mar./Apr. 1993, pp. 429-432.

(Continued)

*Primary Examiner*—Richard Hjerpe
*Assistant Examiner*—Kevin M. Nguyen
(74) *Attorney, Agent, or Firm*—Reed Smith LLP; Stanley P. Fisher, Esq.; Juan Carlos A. Marquez, Esq.

(57) ABSTRACT

The present invention provides an image display capable of reducing power used up or consumed by a thin-film electron-emitter matrix. As a typical one, there is provided an image display which comprises a display device including a first plate which has a plurality of electron-emitter elements each having a structure comprised of a base electrode, an insulating layer and a top electrode stacked on one another in this order, the electron-emitter element emitting electrons from the surface of the top electrode when a voltage of positive polarity is applied to the top electrode; a plurality of first electrodes for respectively applying driving voltages to the base electrodes of the electron-emitter elements lying in a row direction, of the plurality of electron-emitter elements; and a plurality of second electrodes for respectively applying driving voltages to the top electrodes of the electron-emitter elements lying in a column direction, of the plurality of electron-emitter elements, a frame component, and a second plate having phosphors, wherein a space surrounded by the first plate, the frame component and the second plate is brought into vacuum. In the image display, the first electrode and/or the second electrode held in a non-selected state is set to a high-impedance state.

14 Claims, 9 Drawing Sheets

FOREIGN PATENT DOCUMENTS

| | | |
|---|---|---|
| FR | 2 698 201 | 11/1992 |
| JP | 62-8340 | 7/1985 |
| JP | 2-184890 | 1/1989 |
| JP | 8-305317 | 4/1995 |
| JP | 08-328505 | 5/1995 |
| JP | 2000-206925 | 1/1999 |

OTHER PUBLICATIONS

Nobuyasu Negishi, Takashi Chuman, Shingo Iwasaki, Takamasa Yoshikawa, Hiroshi Ito and Kiyohide Ogasawara, "High Efficienciy Electron-Emission in Pt/$SiO_x$/Si/Al Structure", Jpn. J. Appl. Phys. vol. 36 (1997), Jul. 15, 1997, pp. 939-941.

Nobuyoshi Koshida, Tsuyoshi Ozaki, Xia Sheng, and Hideki Koyama, "Cold Electron Emission from Electroluminesacent Porous Silicon Diodes", Jpn. J. Appl. Phys. vol. 34 (1995), Jun. 1, 1995, pp. 705-707.

Japanese Office Action dated Dec. 6, 2005, of the corresponding Japanese patent application 11-256246, with English translation of paragraphs 3 and 4.

* cited by examiner

IMAGE DISPLAY AND METHOD OF DRIVING IMAGE DISPLAY

BACKGROUND OF THE INVENTION

The present invention relates to an image display and a method of driving the same, and particularly to a technology effective for application to a display apparatus which has thin-film electron emitters having an electrode-insulator-electrode structure to emit electrons into vacuum.

The thin-film electron emitters are electron-emitter elements each using hot electrons produced by applying a high electric field to an insulator.

As a typical example, an MIM (Metal-Insulator-Metal) electron emitter comprising a three-layer thin-film structure of a top electrode-insulating layer-base electrode will be explained.

FIG. 13 is a diagram for describing the principle of operation of an MIM electron emitter illustrated as a typical example of a thin-film electron emitter.

A driving voltage is applied between a top electrode 11 and a base electrode 13 to set an electric field in a tunneling insulator 12 to 1 MV/cm to 10 MV/cm and over. Thus, electrons placed in the neighborhood of a Fermi level in the base electrode 13 are transmitted through a barrier by tunneling phenomena. Thereafter they are injected into a conduction band of the tunneling insulator 12 and further injected into the top electrode 11, thus resulting in hot electrons.

Some of these hot electrons are subjected to scattering under interaction with a solid in the tunneling insulator 12 and the top electrode 11, thus leading to the loss of energy.

As a result, hot electrons having various energies exist when they have reached an interface between the top electrode 11 and vacuum 10.

Of these hot electrons, ones having energy of a work function $\phi$ or more of the top electrode 11 are emitted into the vacuum 10, and ones other than the above ones flow into the top electrode 11.

Assuming that a current based on the electrons that flows from the base electrode 13 to the top electrode 11, is called a diode current (Id), and a current based on the electrons emitted into the vacuum 10 is called an emission current (Ie), an electron emission efficiency (Ie/Id) ranges from about $1/10^3$ to about $1/10^5$.

Incidentally, the MIM thin-film electron emitter has been described in, for example, Japanese Patent Application Laid-Open No. Hei 9-320456.

Now, the top electrode 11 and the base electrode 13 are provided in plural form and these plural top electrodes 11 and base electrodes 13 are made orthogonal to one another to thereby form thin-film electron emitters in matrix form. Consequently, electron beams can be produced from arbitrary locations and hence they can be used as electron emitters for a display apparatus.

Namely, a display apparatus can be constructed wherein thin-film electron-emitter elements are placed every pixels and electrons emitted therefrom are accelerated in vacuum and thereafter applied to each of phosphors to thereby allow the applied phosphor to emit light, whereby a desired image is displayed thereon.

The thin-film electron emitters have excellent features as electron-emitter elements for the display apparatus in that they are capable of implementing a high-resolution display apparatus because the emitted electron beams are excellent in directionality, and they are easy to handle because they are insusceptible to the influence of their surface contamination, for example.

Even except for the above-described MIM thin-film electron emitter, there are known, as thin-film electron emitters, a MIS (Metal-Insulator-Semiconductor) type (described in, for example, Journal of Vacuum Science and Technologies B, Vol. 11, pp. 429–432) using a semiconductor as a base electrode, one (described in, for example, Japanese Journal of Applied Physics, Vol. 36, Part 2, No. 7B, pp L939–L941 (1997)) using a semiconductor-insulator multi-layer film as a tunneling insulator, one (described in, for example, Japanese Journal of Applied Physics, Vol. 34, Part 2, No. 6A, pp. L705–L707 (1995)) using porous silicon as a tunneling insulator, etc.

A display apparatus using a thin-film electron-emitter matrix makes no use of a shadow mask like a cathode-ray tube (Cathode-ray tube; CRT) and has no beam deflection circuit. Therefore power consumption thereof is slightly lower than that of CRT or the same degree as that.

Power used up or consumed by the thin-film electron-emitter matrix is roughly calculated according to a conventional driving method for the display apparatus using the thin-film electron-emitter matrix.

FIG. 14 is a diagram showing a schematic configuration of a conventional thin-film electron-emitter matrix.

Thin-film electron-emitter elements 301 are respectively formed at points where row electrodes (base electrodes) 310 and column electrodes (top electrodes) 311 intersect respectively.

Incidentally, while the thin-film electron-emitter matrix is illustrated with 3 rows and 3 columns in FIG. 14, the thin-film electron-emitter elements 301 are actually placed by the number of pixels constituting a display apparatus, or the number of sub-pixels in the case of a color display apparatus.

Namely, as the number of rows N and the number of columns M, N ranges from several hundreds of rows to a few thousand rows and M ranges from several hundreds of columns to a few thousand columns as typical examples, respectively.

Incidentally, while one pixel is formed of a combination of respective sub-pixels of red, blue and green in the case of a color image display, ones equivalent to sub-pixels employed in the case of the color image display will be called "pixels" in the present specification. In the present specification, the pixels or sub-pixels are also called "dots".

FIG. 15 is a timing chart for describing the conventional method of driving the display apparatus.

A row electrode driving circuit 41 applies a negative polarity pulse (scan pulse) having amplitude ($V_{row}$) to one of the row electrodes 310 (a selected scan electrode). Simultaneously column electrode driving circuits 42 apply positive polarity pulses (data pulses) each having amplitude ($V_{col}$) to some (their corresponding selected column electrodes) of the column electrodes 311.

Since a voltage enough to emit electrons is applied to each thin-film electron-emitter element 301 in which the two pulses overlap each other, the electrons are emitted therefrom. The electrons excite each of phosphors to emit light therefrom.

In the case of the thin-film electron-emitter element 301 free of the application of the positive polarity pulse having the amplitude ($V_{col}$) thereto, a sufficient voltage is not applied thereto and hence no electron emission is produced.

The row electrodes 310 to be selected, i.e., the row electrodes 310 to which the scan pulse is applied, are successively selected and the data pulses applied to the column electrodes 311 in association with rows for the selected row electrodes are also changed.

When all the rows are scanned in this way during one field period, an image corresponding to an arbitrary image can be displayed.

During a given period in one field, pulses of reverse polarity (reverse pulses) are respectively applied to all the row electrodes.

Thus, the thin-film electron-emitter elements 301 can be operated stably.

Dissipation power of each driving circuit is calculated according to the conventional driving method when the electrostatic capacitance per one of the thin-film electron-emitter elements 301 is represented as Ce, the number of the column electrodes 311 is represented as M and the number of the row electrodes 310 is represented as N.

The dissipation power is equivalent to power used up or consumed to charge the electrostatic capacitance of each driven element and discharge the same therefrom. The dissipation power does not contribute to light emission.

Dissipation power produced with the application of scan pulses will first be determined.

Dissipation power at the time that a pulse having amplitude ($V_{row}$), is applied to the corresponding row electrode 310 once, is expressed in the following equation (1):

$$M \cdot Ce \cdot (V_{row})^2 \tag{1}$$

Assuming that the number of refreshing images (field frequency) per second is given as f, the whole dissipation power ($P_{row}$) for N row electrodes is expressed in the following equation (2):

$$P_{row} = f \cdot N \cdot M \cdot Ce \cdot (V_{row})^2 \tag{2}$$

Similarly, dissipation power ($P_r$) consumed with the application of reverse pulses is given by the following equation (3):

$$P_r = f \cdot N \cdot M \cdot Ce \cdot (V_r)^2 \tag{3}$$

where $V_r$ indicates the voltage amplitude of the reverse pulse applied to the row electrode 310.

Since N thin-film electron-emitter elements 301 are connected to one column electrode 311, the whole dissipation power ($P_{col}$) for M column electrodes is given by the following equation (4) where pulse voltages are applied to all of the M column electrodes 311:

$$P_{col} = f \cdot M \cdot N \cdot (N \cdot Ce \cdot (V_{col})^2) \tag{4}$$

Since the pulses are applied to the column electrodes N times during a screen-refreshing period (one field period), $P_{col}$ is additionally multiplied by N as compared with $P_{row}$.

Incidentally, when pulse voltages are respectively applied to m of the M column electrodes 311, M in the equation (4) is substituted with m.

Using f=60 Hz, N=480, M=1920, Ce=0.1 nF, and $V_{row}$=Vr=$V_{col}$=4V as typical values, for example, results in $P_{row}$=$P_r$=0.09 [W] and $P_{col}$=42[W].

Since, in this case, the power consumption of the thin-film electron-emitter element per se becomes about 1.6[W], the total power consumption results in about 44[W]. This is practically problem-free power consumption.

It is however understood that when it is desired to further achieve low power consumption, a reduction in dissipation power $P_{col}$ consumed with the application of the data pulse is effective.

Thus, even the prior art presents no problem in terms of power consumption when used as the display apparatus in a similar use as the CRT.

However, the feature of the display apparatus using the thin-film electron emitters is to enable the implementation of a thin flat-panel display.

This type of thin flat-panel display has a use as for a portable display apparatus. In this case, power consumption may preferably be further reduced.

SUMMARY OF THE INVENTION

The present invention has been made to solve the problems of the prior art. An object of the present invention is to provide a technology capable of reducing power consumed by a thin-film electron-emitter matrix in an image display.

Another object of the present invention is to provide a technology capable of reducing power used up or consumed by a thin-film electron-emitter matrix according to a method of driving an image display.

The above, other objects and novel features of the present invention will become apparent from the description of the present specification and the accompanying drawings.

The present invention is characterized in that as shown in a timing chart of FIG. 1, for example, a row electrode 310 placed in a non-selected state are set to a high-impedance state, or row electrodes 310 in a non-selected state and column electrodes 311 in a non-selected state are both set to a high-impedance state.

In order to set the row electrode 310 or column electrode 311 to the high-impedance state, there is known a method of setting an output signal line connected to its corresponding row electrode 310 or column electrode 311 to a floating state inside a row electrode driving circuit 41 or a column electrode driving circuit 42, for example.

Next, power consumption in the thin-film electron-emitter matrix is roughly calculated by the driving method for the image display, according to the present invention.

Let's first consider where the output of the row electrode driving circuit 41 for supplying a driving voltage to the corresponding row electrode 310 held in a non-selected state has been set to a high-impedance state.

FIG. 2 is a diagram showing an equivalent circuit where one row electrode (selected scan line in FIG. 2) 310 is selected and the remaining (N-1) row electrodes (non-selected scan lines in FIG. 2) 310 are respectively brought into a high-impedance state, and simultaneously m column electrodes (selected data lines in FIG. 2) 311 are selected and (M-m) non-selected column electrodes (non-selected data lines in FIG. 2) 311 are respectively fixed to the ground potential.

As shown in FIG. 2, a circuit network extending through the non-selected row electrodes 310 and the non-selected column electrodes 311 must be taken into consideration even in addition to m thin-film electron-emitter elements 301 placed at points where the selected row electrodes 310 and the selected column electrodes 311 intersect respectively.

In the equivalent circuit shown in FIG. 2, electrostatic capacitance $C_1(m)$ between one selected row electrode 310 and them selected column electrodes 311 is expressed in the following equation (5):

$$C_1(m) = \left\{ m + \frac{m(M-m)(N-1)}{M} \right\} C_e \tag{5}$$

FIG. 3 is a graph showing how $C_1(m)$ vary with m.

In FIG. 3, the vertical axis indicates output capacitance of all the column electrodes 311 in units obtained by dividing the same by an electrostatic capacitance per pixel Ce.

In FIG. 3, N=500 and M=3000. In the drawing, marks ○ indicate a case based on the conventional driving method and marks ● indicate a case based on the driving method of the present invention.

While $C_1(m)$ reaches the maximum when m=M/2, it still becomes ¼ of the maximum value obtained according to the conventional driving method.

Thus, the driving method of the present invention is capable of reducing dissipation power ($P_{col}$) consumed with the application of a data pulse to ¼.

Next consider where each column electrode 311 kept in a non-selected state is also brought into a high-impedance state.

FIG. 4 is a diagram showing an equivalent circuit where one row electrode (selected scan line in FIG. 4) 310 is selected and the remaining (N-1) row electrodes (non-selected scan lines in FIG. 4) 310 are respectively brought into a high-impedance state, and simultaneously m column electrodes (selected data lines in FIG. 4) 311 are selected and (M-m) non-selected column electrodes (non-selected data lines in FIG. 4) 311 are respectively brought into a high-impedance state.

In the equivalent circuit shown in FIG. 4, electrostatic capacitance $C_2(m)$ between one selected row electrode 310 and them selected column electrodes 311 is expressed in the following equation (6):

$$C_2(m) = \left\{ m + \frac{m(M-m)(N-1)}{M+m(N-1)} \right\} C_e \tag{6}$$

FIG. 5 is a graph showing how $C_2(m)$ varies with m.

In FIG. 5, the vertical axis indicates output capacitance of all the column electrodes 311 in units obtained by dividing the output capacitance by electrostatic capacitance per pixel Ce.

In FIG. 5, N=500 and M=3000. In the drawing, marks ○ indicate $C_2(m)$, and marks ● indicate a case wherein only non-selected scan electrodes are respectively brought into a high-impedance state for comparison ($C_1(m)$).

When m=M/2, for example, $C_2(m)$ is further reduced to 1/100 or less as compared with $C_1(m)$.

Thus, the driving method of the present invention is capable of reducing the dissipation power ($P_{col}$) incident to the application of the data pulse to 1/100 or less as compared with the conventional one.

In general, a driving method of a matrix-addressed display such as a liquid-crystal display or the like avoids the setting of a given electrode to a high-impedance state.

This is because when there is an electrode held in a high-impedance state, a crosstalk phenomenon is apt to occur, and hence degradation in image quality occurs and failures such as the inability to display a desired image in some cases occur.

The present inventors have focused attention on the fact that the crosstalk due to the introduction of such a high-impedance state will occur because the voltage of the electrode held in the high-impedance state is not fixed, depending on the number of lighting dots (i.e., displayed image) in its peripheral dots, and/or the voltage of its adjacent electrode, etc.

Another point that has led to the devisal of the present invention, resides in that the present inventors have focused attention on the fact that a thin-film electron emitter does not emit electrons unless a sufficient current is supplied thereto from an external circuitry, i.e., it has an aspect that will operate as a current-driven device.

As mentioned previously, the mechanism of emitting the electrons from each thin-film electron emitter uses the tunneling current generated by the electric field lying within the tunneling insulator as the hot electrons, and therefore is of a voltage-driven type in this respect.

Since, however, the emission current (Ie) is about $10^{-3}$ of the tunneling current, a current of about $10^3$ times the emission current must be supplied from an external circuitry to obtain a desired emission current. Therefore, the electron emission mechanism has an aspect that operates as a current-driven device.

Therefore, the thin-film electron emitter does not cause electron emission if the impedance thereof is sufficiently high even if the potential at each electrode is other than a desired value.

Therefore, the thin-film electron emitter does not cause the crosstalk even if the driving method of the present invention is used.

The present invention has been made on the basis of the above findings. A summary of a typical one of the inventions disclosed in the present application will be described in brief as follows:

There is provided an image display which comprises a display device including a first plate which has a plurality of electron-emitter elements each having a structure comprised of a base electrode, an insulating layer and a top electrode stacked on one another in this order, the electron-emitter element emitting electrons from the surface of the top electrode when a voltage of positive polarity is applied to the top electrode; a plurality of first electrodes for respectively applying driving voltages to the base electrodes of the electron-emitter elements lying in a row (or column) direction, of the plurality of electron-emitter elements; and a plurality of second electrodes for respectively applying driving voltages to the top electrodes of the electron-emitter elements lying in the column (or row) direction, of the plurality of electron-emitter elements, a frame component, and a second plate having phosphors, whereby a space surrounded by the first plate, the frame component and the second plate is brought to vacuum, wherein the first electrode held in the non-selected state is set to a state of having an impedance higher than that of the corresponding first electrode held in the selected state, or each of the first and second electrodes held in the non-selected state is set to a state of having an impedance higher than that of each of the first and second electrodes held in the selected state.

Incidentally, a prior-art search has been carried out based on the result of the present invention from the viewpoint that each electrode held in the non-selected state is brought into high impedance.

As a result, the corresponding art has not been found in the display apparatus using the thin-film electron emitters, which is intended for the present invention.

DETAILED DESCRIPTION OF THE PREFERRED EMBODIMENTS

Figure 1:
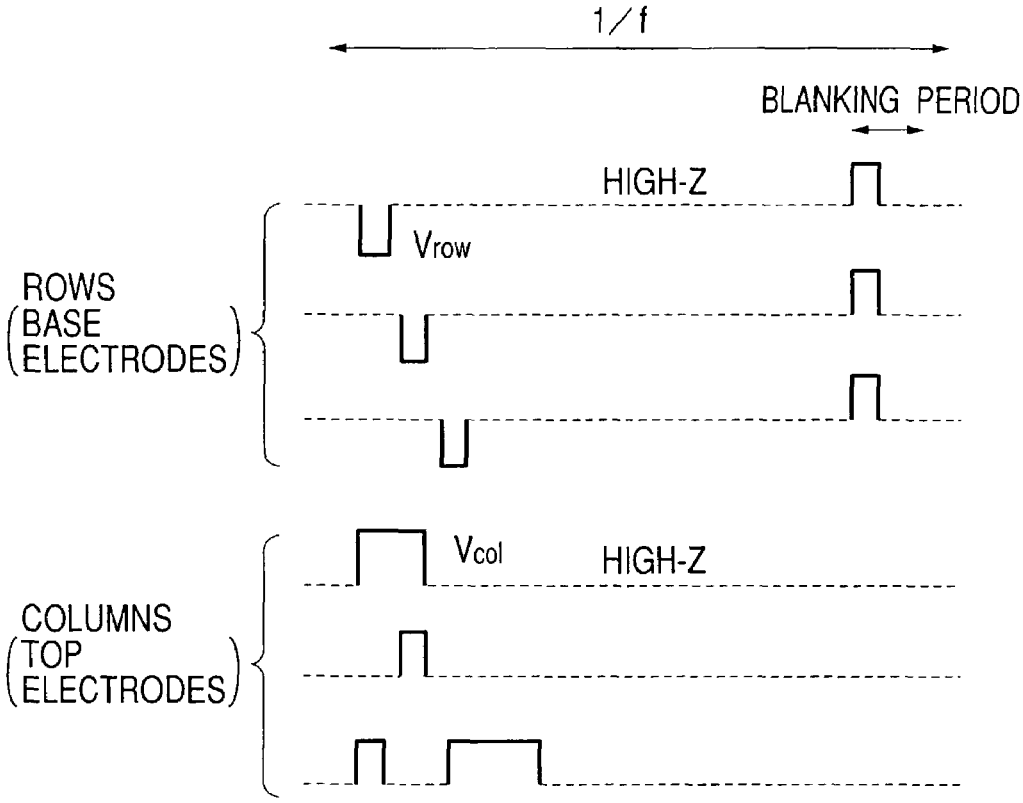
FIG. 1 is a diagram for describing a method of driving an image display of the present invention.
Figure 2:
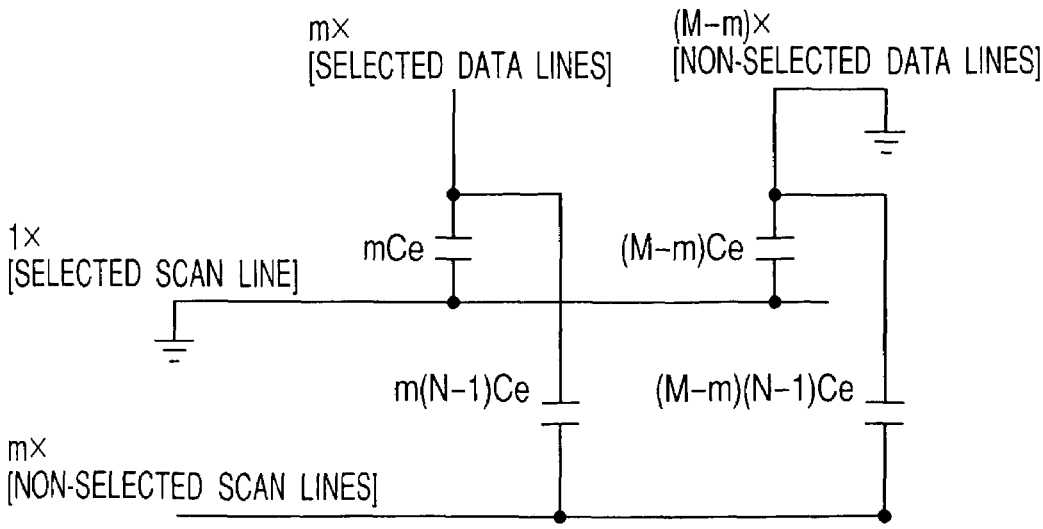
FIG. 2 is a diagram showing an equivalent circuit for calculating the capacitance between electrodes according to the method of driving the image display of the present invention.
Figure 3:
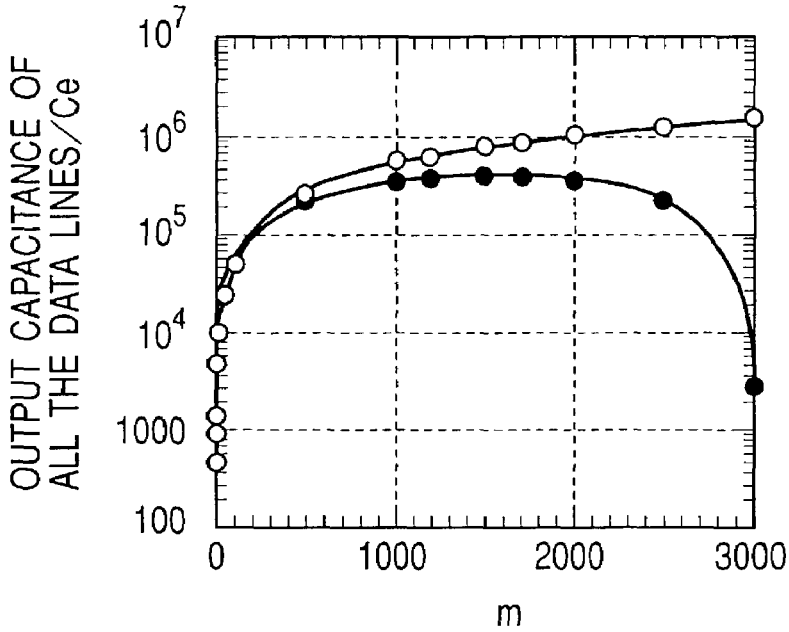
FIG. 3 is a graph showing changes in the capacitance between the electrodes calculated by the equivalent circuit shown in FIG. 2.
Figure 4:
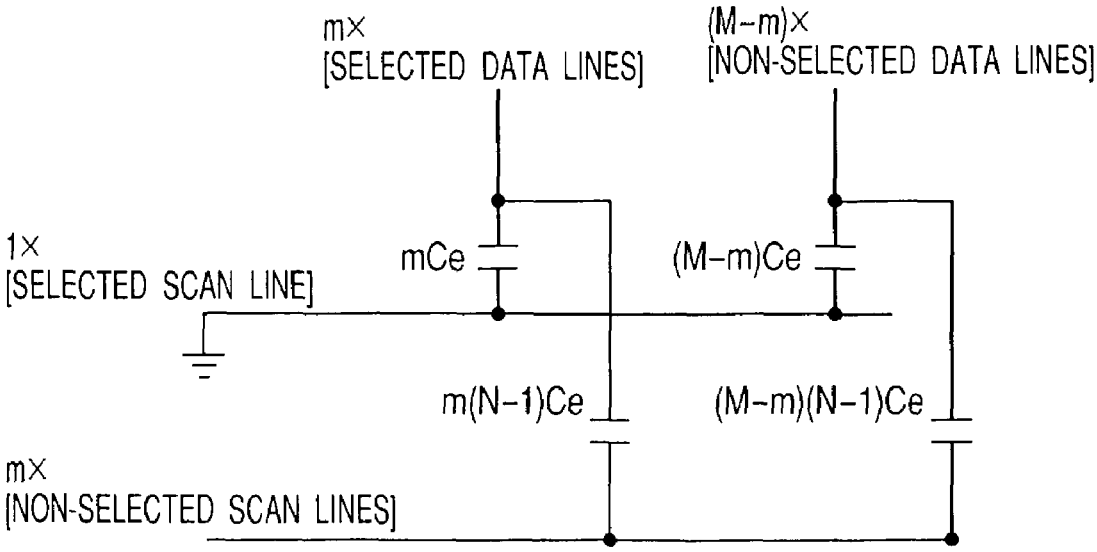
FIG. 4 is a diagram illustrating an equivalent circuit for calculating the capacitance between electrodes according to the method of driving the image display of the present invention.
Figure 5:
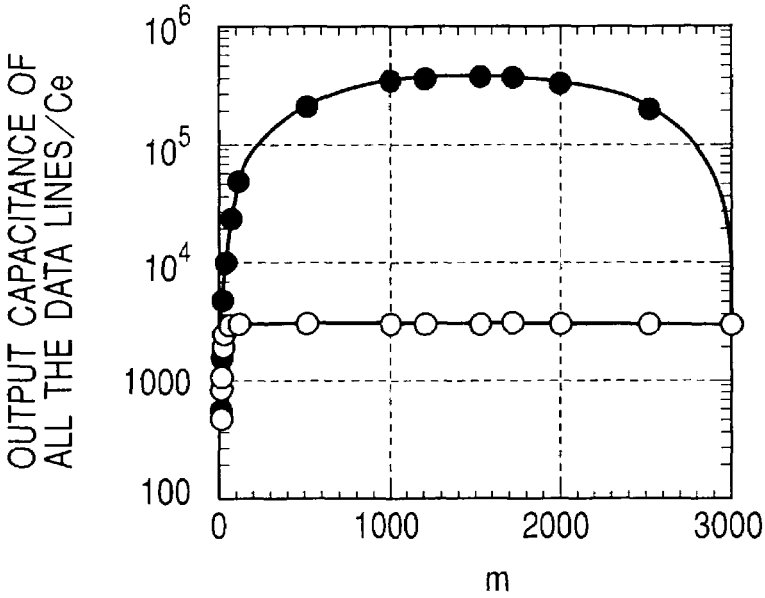
FIG. 5 is a graph showing changes in the capacitance between the electrodes calculated by the equivalent circuit shown in FIG. 4.

Preferred embodiments of the present invention will hereinafter be described in detail with reference to the accompanying drawings.

Incidentally, elements of structure each having the same function in all drawings for describing the embodiments are respectively identified by the same reference numerals and their repetitive description will therefore be omitted.

Embodiment 1

An image display according to an embodiment 1 of the present invention has a configuration wherein a display panel (display device of the present invention) in which brightness-modulation elements for respective dots are formed according to combinations of a thin-film electron-emitter matrix corresponding to an electron emitter used for emitting electrons and phosphors, is used to connect driving circuits to row electrodes and column electrodes of the display panel respectively.

Now the display panel comprises a cathode plate formed with a thin-film electron-emitter matrix, and a phosphor plate formed with phosphor patterns.

Figure 6:
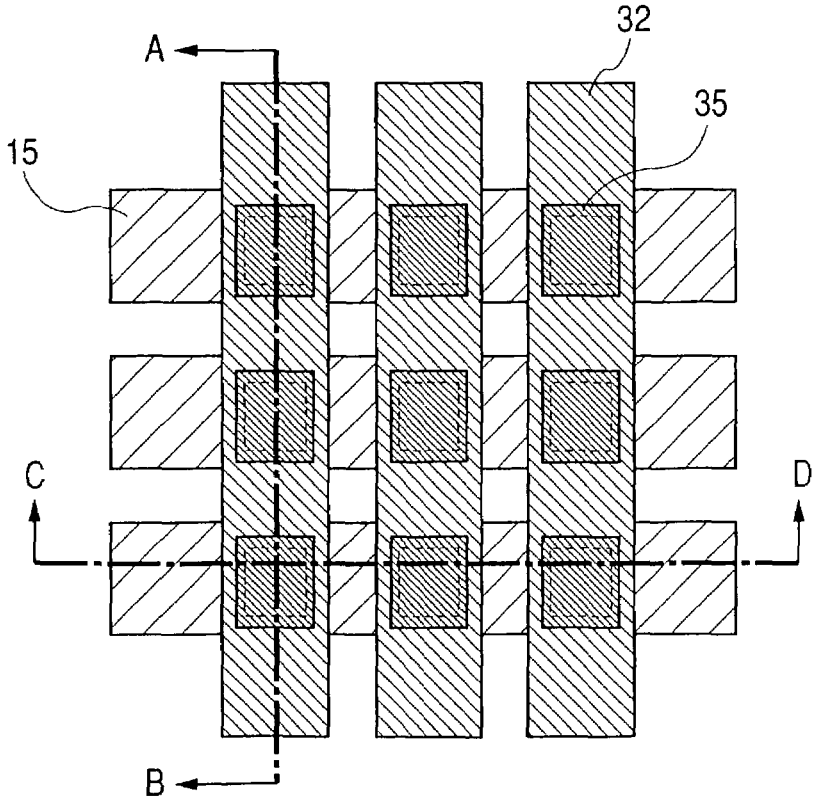
FIG. 6 is a plan view illustrating a configuration of part of a thin-film electron-emitter matrix of a cathode plate employed in an embodiment 1 of the present invention.
Figure 7:
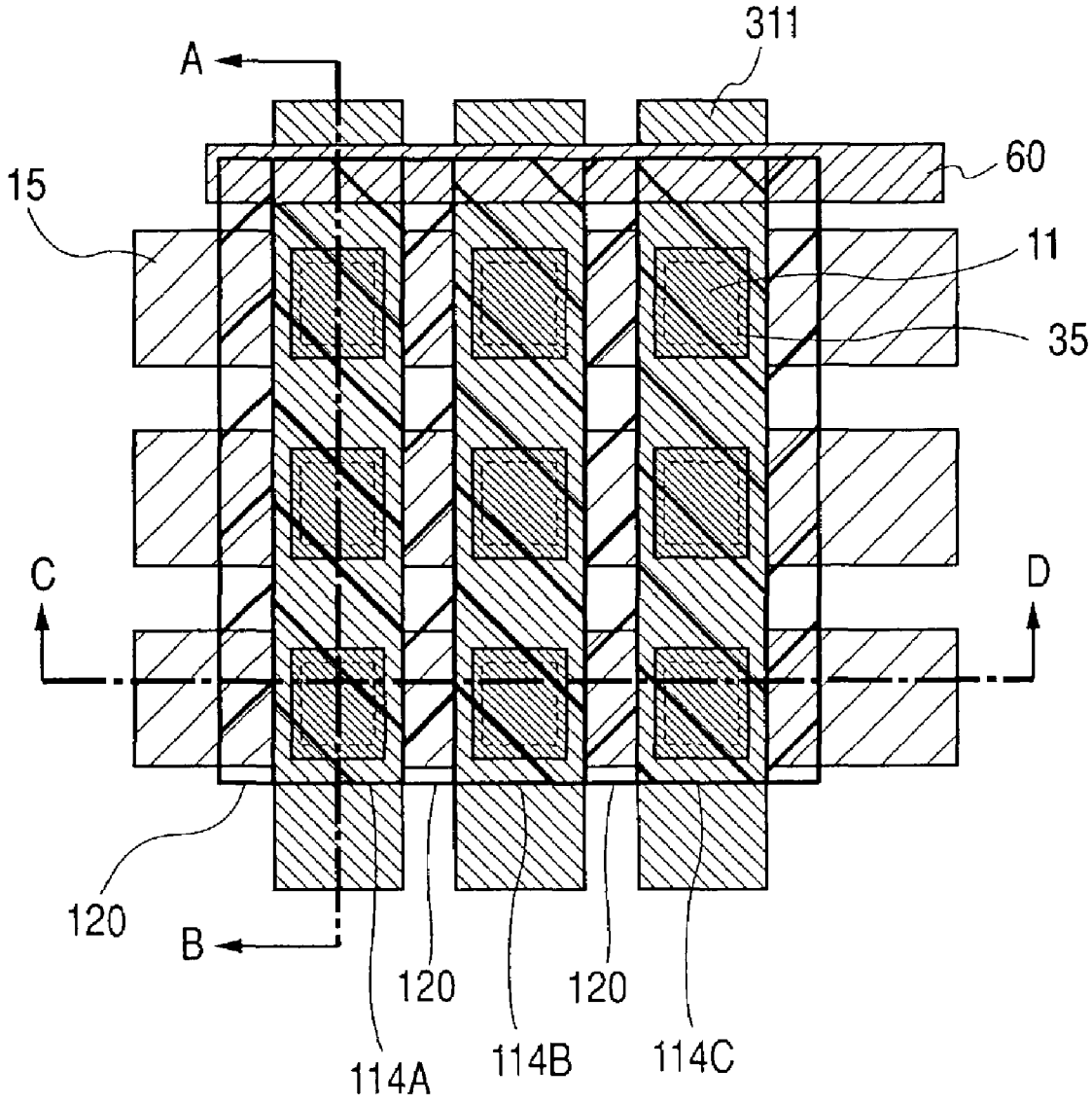
FIG. 7 is a plan view showing the relationship in position between the cathode plate and a phosphor plate employed in the embodiment 1 of the present invention.

FIG. 6 is a plan view showing a configuration of part of a thin-film electron-emitter matrix of a cathode plate according to the present embodiment, and FIG. 7 is a plan view showing the relationship in position between the cathode plate and phosphor plate according to the present embodiment, respectively.

Figure 8:
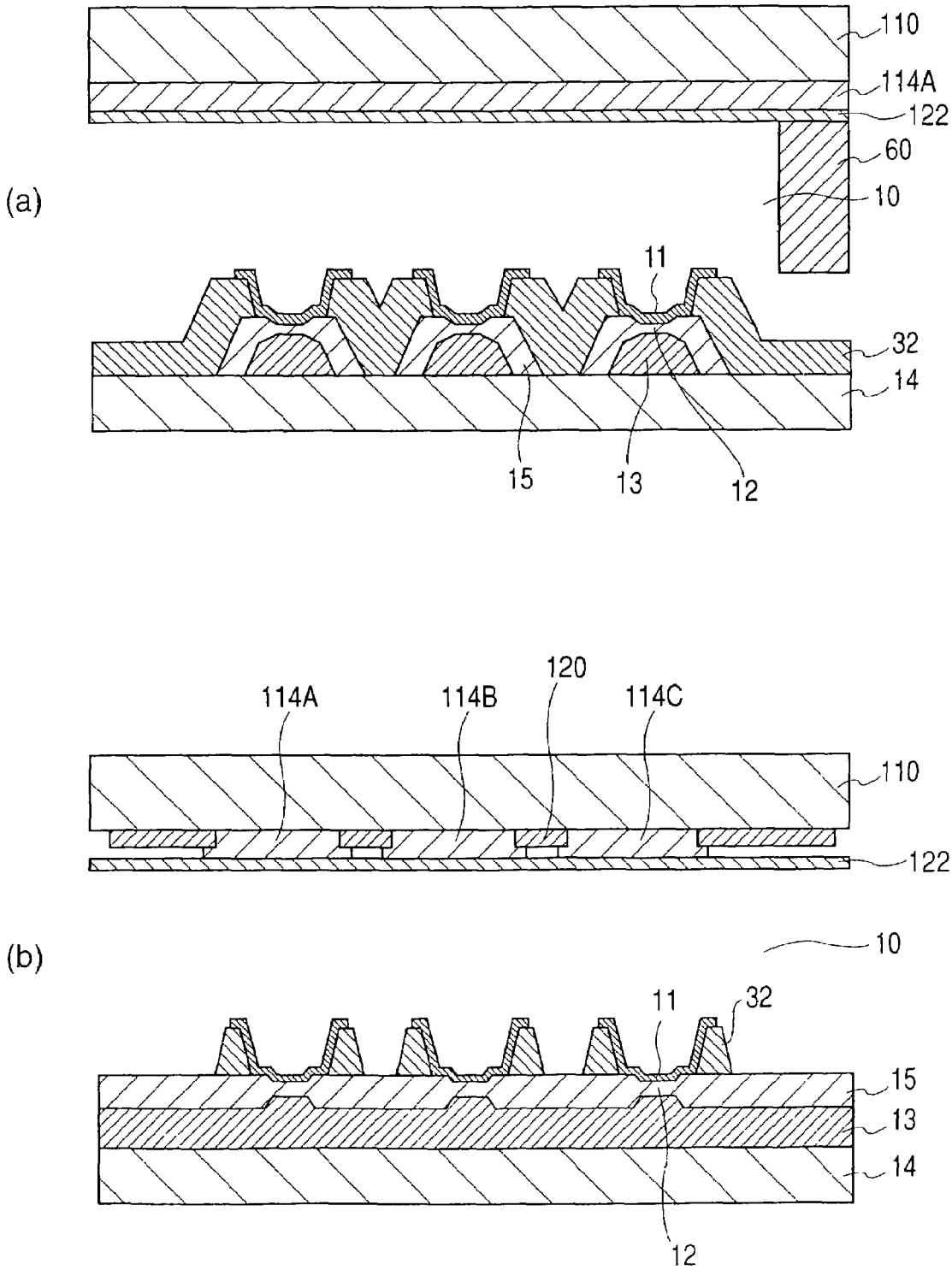
FIGS. 8(*a*) and 8(*b*) are respectively fragmentary cross-sectional views depicting a configuration of a display apparatus according to the embodiment 1 of the present invention.

FIG. 8 is a fragmentary cross-sectional view showing a configuration of the display apparatus according to the present embodiment, wherein FIG. 8(*a*) is cross-sectional views taken along cut lines A–B shown in FIGS. 6 and 7, and FIG. 8(*b*) is cross-sectional views taken along cut lines C–D shown in FIGS. 6 and 7.

However, the illustration of a plate 14 is omitted from FIGS. 6 and 7.

Further, a reduction scale as viewed in a vertical height direction is arbitrary in FIG. 8. Namely, while base electrodes 13, top electrode buslines 32, and the like are respectively less than or equal to a few μm in thickness, the distance between the plate 14 and a plate 110 is equivalent to a length of from about 1 mm to about 3 mm.

While the following description is made using an electron-emitter matrix with 3 rows and 3 columns, it is needless to say that the numbers of rows and columns in an actual display panel respectively result in several hundreds rows to a few thousand rows, and a few thousand columns.

In FIG. 6, regions 35 surrounded by dot lines indicate electron-emission regions (electron-emitter elements in the present invention) respectively.

Each of the electron-emission regions 35 emits electrons into vacuum from within its area or region at a location defined by a tunneling insulator 12.

Since the electron-emission region 35 is not represented on a plan view because it is covered with a top electrode 11, it is illustrated by a dotted line.

Figure 9:
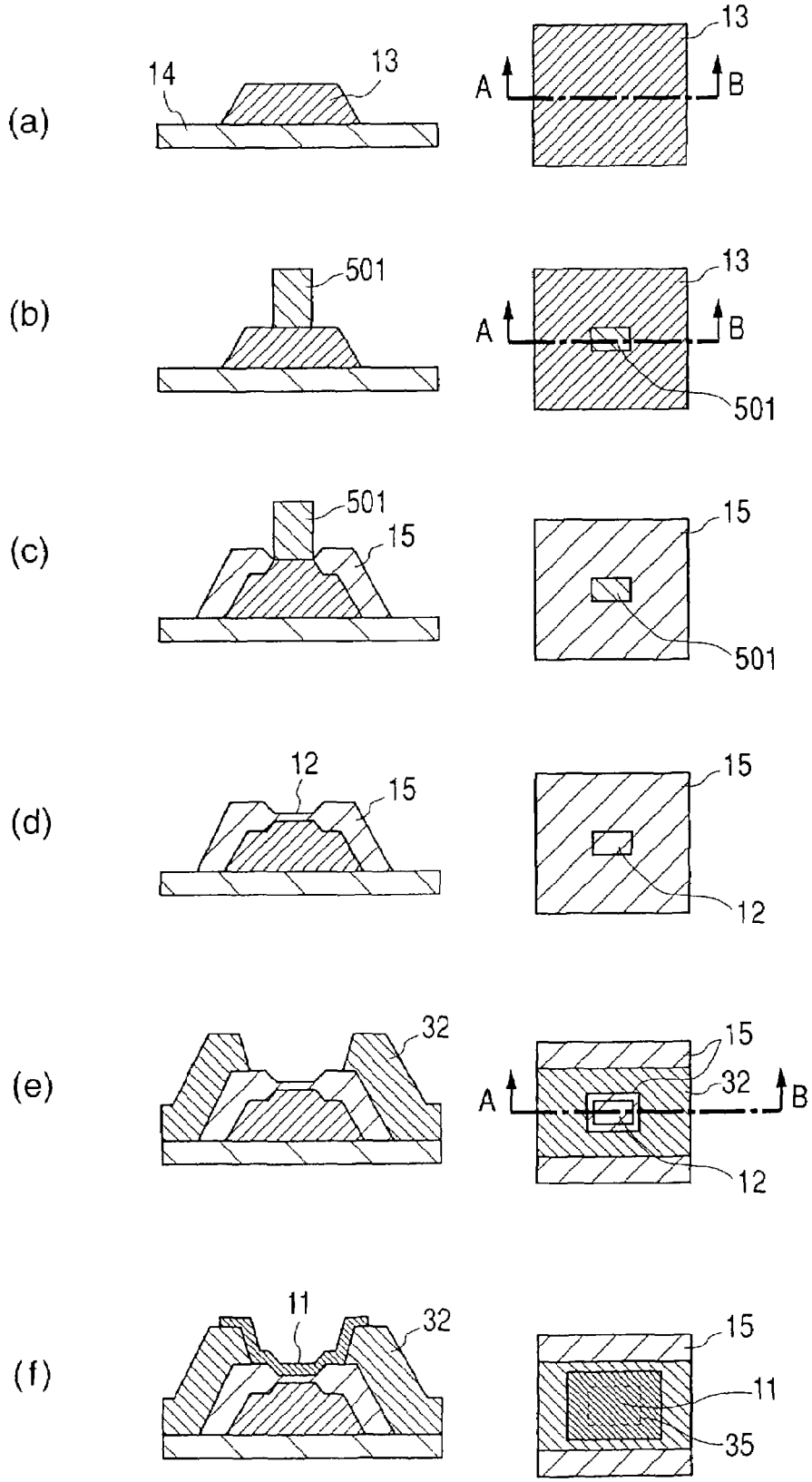
FIGS. 9(*a*) through 9(*f*) are respectively diagrams for describing a method of manufacturing a cathode plate employed in the embodiment 1 of the present invention.

FIG. 9 is a diagram for describing a method of manufacturing a cathode plate employed in the present embodiment.

A method of fabricating a thin-film electron-emitter matrix of the cathode plate employed in the present embodiment will be explained below with reference to FIG. 9.

Incidentally, while only one thin-film electron emitter 301 formed at the intersection of one of row electrodes 310 and one of column electrodes 311 (both shown in FIGS. 6 and 7), is extracted and plotted in FIG. 9, a plurality of thin-film electron emitters 301 are actually arranged in matrix form as illustrated in FIGS. 6 and 7.

Further, the right columns shown in FIG. 9 are respectively plan views, whereas the left columns are respectively cross-sectional views taken along lines A–B in the views on the right side.

An electrically conductive film for a base electrode 13 is formed with a thickness of 300 nm, for example, on an insulative substrate 14 such as glass or the like.

As a material for the base electrode 13, may be used, for example, an aluminum (Al: hereinafter called "Al") alloy.

In the present method, an Al-neodymium (Nd: hereinafter called "Nd") alloy is used.

For example, a sputtering method, resistive-heating evaporation or the like may be used to form such an Al alloy film.

Next, the Al alloy film is processed into strip form by resist formation using photolithography and etching following it to thereby form a base electrode 13 as shown in FIG. 9(*a*).

The base electrode 13 assumes the role of the row electrode 310.

A resist used herein may be one suitable for etching, and both of wet etching and dry etching may be used as the etching.

Next, a resist is applied and exposed with an ultraviolet-ray, followed by patterning, thereby forming a resist pattern 501 as shown in FIG. 9(*b*).

As the resist, may be used, for example, a quinonediazide positive resist.

Next, anodic oxidation is done while the resist pattern 501 remains attached to the base electrode 13 to thereby form a protection layer 15 as shown in FIG. 9(*c*).

In the present embodiment, an anodization voltage was set to about 100V upon such anodic oxidation, and the thickness of the protection layer 15 was set to about 140 nm.

The resist pattern 501 is removed with an organic solvent such as acetone or the like and thereafter the surface of the base electrode 13 covered with the resist is anodically oxidized again to thereby form a tunneling insulator 12 as shown in FIG. 9(*d*).

In the present embodiment, an anodization voltage was set to 6V upon such re-anodization, and the thickness of the tunneling insulator was set to 8 nm.

Next, an electrically conductive film for a top electrode busline 32 is formed and the resist is patterned and subjected to etching to thereby form the top electrode busline 32 as shown in FIG. 9(*e*).

In the present embodiment, the top electrode busline 32 made use of the Al alloy, and the thickness thereof was set to about 300 nm.

Incidentally, gold (Au) or the like may be used as a material for the top electrode busline 32.

Incidentally, the top electrode busline 32 is provided in such a way that the edges of the pattern therefor are etched so as to take a taper-shape and a top electrode 11 to be formed subsequently will not cause a break due to a step at the edges of the pattern.

Here, the top electrode busline 32 shares the role of the column electrode 311.

Next, an iridium (Ir) having a thickness of 1 nm, a platinum (Pt) having a thickness of 2 nm, and a gold (Au) having a thickness of 3 nm are formed by sputtering in that order.

According to a resist and patterning by etching, a multi-layer film of Ir—Pt—Au is patterned as the top electrode 11 as shown in FIG. 9(*f*).

Incidentally, a region 35 surrounded by a dotted line indicates an electron emission region in FIG. 9(*f*).

The electron-emission region 35 emits electrons into vacuum from within its area or region at a location defined by the tunneling insulator 12.

The thin-film electron-emitter matrix is completed on the plate 14 according to the above-described process.

In the thin-film electron-emitter matrix as described above, electrons are emitted from the region (electron-emission region 35) defined by the tunneling insulator 12, i.e., the region defined by the resist pattern 501.

Further, since the protection layer 15, which is of a thick insulating film, is formed around the perimeter of the electron-emission region 35, an electric field applied between the top electrode and the base electrode does not concentrate at sides or edges of the base electrode 13 and hence an electron emission characteristic stable over a long time is obtained.

The phosphor plate according to the present embodiment comprises black matrixes 120 formed on a plate 110 such as sodalime glass or the like, phosphors (114A through 114C) of red (R), green (G) and blue (B), which are formed within trenches or grooves of the black matrixes 120, and a metal back film 122 formed over these.

A method of manufacturing the phosphor plate according to the present embodiment will be explained below.

The black matrixes 120 are formed on the plate 110 with the object of increasing the contrast ratio of the display apparatus (see FIG. 8(*b*)).

Next, the red phosphor 114A, green phosphor 114B and blue phosphor 114C are formed.

These phosphors were patterned by photolithography in a manner similar to being used in the phosphor screen of the normal cathode-ray tube.

As the phosphors, for example, $Y_2O_2S$:Eu (P22-R), ZnS Cu, Al (P22-G), and ZnS:Ag (P22-B)-were respectively used as red, green and blue.

Next, filming is effected on the plate 110 with a film such as nitrocellulose or the like and thereafter Al is evaporated onto the entire plate 110 with a thickness of from about 50 nm to about 300 nm to thereby produce the metal back film 122.

Thereafter, the plate 110 is heated at about 400° C. to pyrolize organic substances such as a filming film, PVA, etc. The phosphor plate is completed in this way.

The cathode plate and phosphor plate fabricated in this way are sealed with frit glass with a spacer 60 interposed therebetween.

A relationship of positions between the phosphors (114A through 114C) formed in the phosphor plate and the thin-film electron-emitter matrix of the cathode plate is represented as shown in FIG. 7.

Incidentally, the components on the plate 110 are illustrated only by oblique lines alone in FIG. 7 to show the relationship of positions between the phosphors (114A through 114C), the black matrixes 120 and the components.

The relationship between the electron-emission region 35, i.e., the portion where the tunneling insulator 12 is formed, and the width of each phosphor 114 is of importance.

In the present embodiment, the width of the electron-emission region 35 is designed so as to be narrower than that of each of the phosphors (114A through 114C) in consideration of an electron beam emitted from the thin-film electron emitter 301 being slightly broadened spatially.

Further, the distance between the plate 110 and the plate 14 was set so as to range from about 1 mm to about 3 mm.

The spacer 60 is inserted to prevent breakage of the display panel due to an external force of atmospheric pressure when the interior of the display panel is vacuumized.

Thus, when a display apparatus having a display area represented by less than or equal to a width of about 4 cm×a length of about 9 cm is fabricated by using glass having a thickness of 3 mm as for the plates 14 and 110, it can endure the atmospheric pressure owing to mechanical strengths of the plates 110 and 14 per se. It is therefore unnecessary to insert the spacer 60.

The spacer 60 is shaped in the form of a rectangular parallelepiped as shown in FIG. 7 by way of example.

While there are provided posts for the spacers 60 every three rows in the present embodiment, the number of the posts (layout density) may be reduced within an endurable range of mechanical strength.

Plate-shaped or cylindrical or pillar-shape posts made up of glass or ceramic are placed as the spacers 60.

Incidentally, while the spacer 60 seems like being not in contact with the plate 14 in FIG. 8(*a*), it is actually in contact with the column electrodes 311 on the plate 14.

In FIG. 8(*a*), a clearance can be defined by the thickness of the column electrode 311.

The sealed display panel is sealed off by being pumped to a vacuum of about $1\times10^{-7}$ Torr.

In order to maintain the degree of vacuum in the display panel in a high vacuum, a getter film is formed or a getter material is activated at a predetermined position (not shown) lying within the display panel immediately before or after its sealing.

In the case of a getter material with barium (Ba) as a principal component, a getter film can be formed by inductive heating.

The display panel using the thin-film electron-emitter matrix is completed in this way.

Since the distance between the plate 110 and the plate 14 extends long so as to range from about 1 mm to about 3 mm in the present embodiment, an acceleration voltage applied to the metal back 122 can be set to a high voltage of 3 KV to 6 KV. Thus the phosphors for the cathode-ray tube (CRT) can be used for the phosphors (114A through 114C) as described above.

Figure 10:
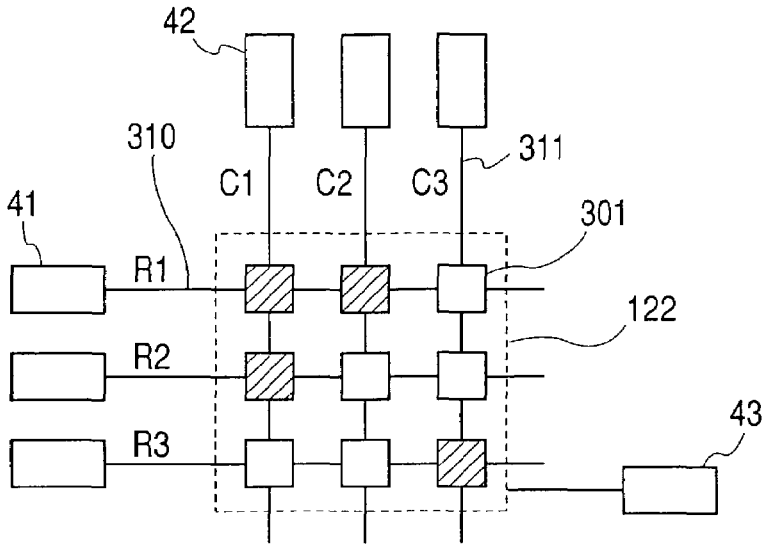
FIG. 10 is a connection diagram illustrating a state in which driving circuits are connected to a display panel employed in the embodiment 1 of the present invention.

FIG. 10 is a connection diagram showing a state in which driving circuits are connected to the display panel according to the present embodiment.

Row electrodes 310 (base electrodes 13) are respectively connected to row electrode driving circuits 41, and column electrodes 311 (top electrode buslines 32) are respectively connected to column electrode driving circuits 42.

Connections between the respective driving circuits (41 and 42) and a cathode plate are made by, for example, one obtained by subjecting a tape carrier package to connect-by-pressure by means of an anisotropically conductive film, or chip-on-glass or the like obtained by directly implementing a semiconductor chip constituting each of the driving circuits (41 and 42) on the plate 14 of the cathode plate.

An acceleration voltage, which ranges from about 3 KV to about 6 KV, is always applied to the metal back film 122 from an acceleration voltage source 43.

Figure 11:
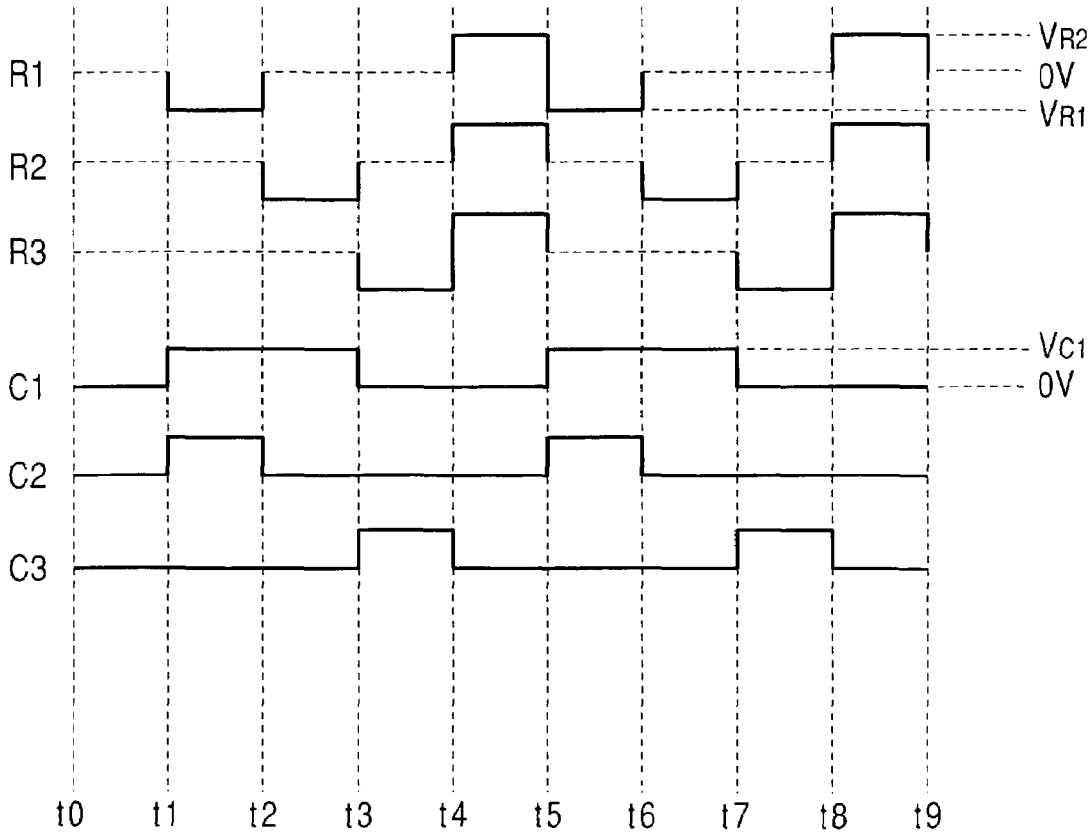
FIG. 11 is a timing chart showing one example illustrative of waveforms of driving voltages outputted from the respective driving circuits shown in FIG. 10.

FIG. 11 is a timing chart showing one example illustrative of waveforms of driving voltages outputted from the respective driving circuits shown in FIG. 10.

Incidentally, dotted lines indicate high-impedance outputs respectively in the same drawings.

In fact, the output impedance may be set so as to range from about 1 Mω to about 10 Mω. In the present embodiment, it was set to 5 Mω.

Let's now assume that an nth row electrode 310 is represented as Rn, an mth column electrode 311 is represented as Cm, and a dot for an intersection of the nth row electrode 310 and the mth column electrode 311 is represented as (n, m).

At a time t0, any electrode carries a voltage of 0 and hence no electrons are emitted, whereby the phosphors (114A through 114C) do not emit light.

At a time t1, the row electrode driving circuit 41 applies a driving voltage of ($V_{R1}$) to its corresponding row electrode 310 of R1, and the column electrode driving circuits 42 apply a driving voltage of ($V_{C1}$) to their corresponding column electrodes 311 of (C1 and C2).

Since a voltage of ($V_{C1}$-$V_{R1}$) is applied between the top electrode 11 and the base electrode 13 for dots (1, 1) and (1, 2), thin-film electron emitters for the two dots emit electrons into vacuum if the voltage of ($V_{C1}$-$V_{R1}$) is set to greater than or equal to a threshold voltage for electron emission.

In the present embodiment, $V_{R1}$=−5V and $V_{C1}$=4.5V.

The emitted electrons are accelerated under the voltage applied to the metal back film 122 and thereafter collide with the phosphors (114A through 114C) to thereby allow the phosphors (114A through 114C) to emit light.

Since the row electrodes 310 of others (R2 and R3) are respectively held in a high-impedance state during this period, no electrons are emitted regardless of the voltage values of the column electrodes 311, and hence the corresponding phosphors (114A through 114C) do not emit light either.

When the row electrode driving circuit 41 applies the driving voltage of ($V_{R1}$) to its corresponding row electrode 310 of R2, and the column electrode driving circuit 42 applies the voltage of ($V_{C1}$) to its corresponding column electrode 311 of C1 at a time t2, a dot (2, 1) lights up similarly.

When the driving voltages having such voltage waveforms as shown in FIG. 11 are applied to their corresponding row and column electrodes 310 and 311, only dots diagonally shaded in FIG. 10 light up.

In this way, changing the signals applied to the column electrodes 311 allows the display of a desired image or information.

By suitably changing the magnitude of the driving voltage ($V_{C1}$) applied to each column electrode 311 in accordance with an image signal, an image having a gray scale can be displayed.

Incidentally, in order to release the charges accumulated in the tunneling insulator 12, the row electrode driving circuits 41 apply a driving voltage of ($V_{R2}$) to all of the row electrodes 310 and simultaneously the column electrode driving circuits 42 apply a driving voltage of 0V to all of the column electrodes at a time t4 in FIG. 11.

Since $V_{R2}$=5V now, a voltage of a $-V_{R2}$=−5V is applied to each thin-film electron emitter 301.

Applying the voltage (reverse pulse) of polarity opposite to upon electron emission in this way allows an improvement in lifetime characteristic of each thin-film electron emitter.

Incidentally, the use of a vertical blanking period of a video signal as reverse pulse applying periods (see t4 to t5 and t8 to t9 in FIG. 11) yields satisfactory matching with the video signal.

Since the row electrodes 310 each held in the non-selected state are set to the high-impedance state in the present embodiment as described above, power consumption can be reduced as mentioned previously.

Embodiment 2

A display panel employed in an image display according to an embodiment 2 of the present invention, and a method of connecting the display panel and driving circuits are identical to those in the aforementioned embodiment.

Figure 12:
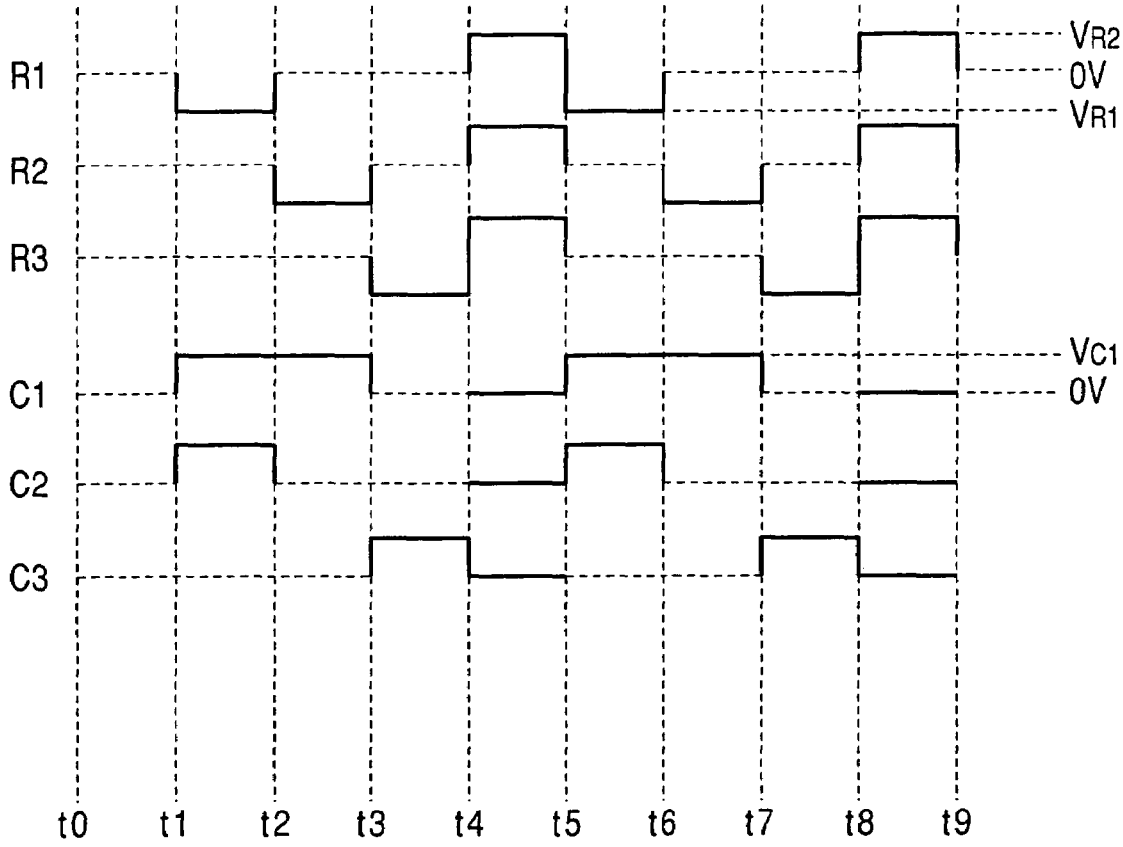
FIG. 12 is a timing chart showing one example illustrative of waveforms of driving voltages outputted from row electrode and column electrode driving circuits in an image display according to an embodiment 2 of the present invention.
Figure 13:
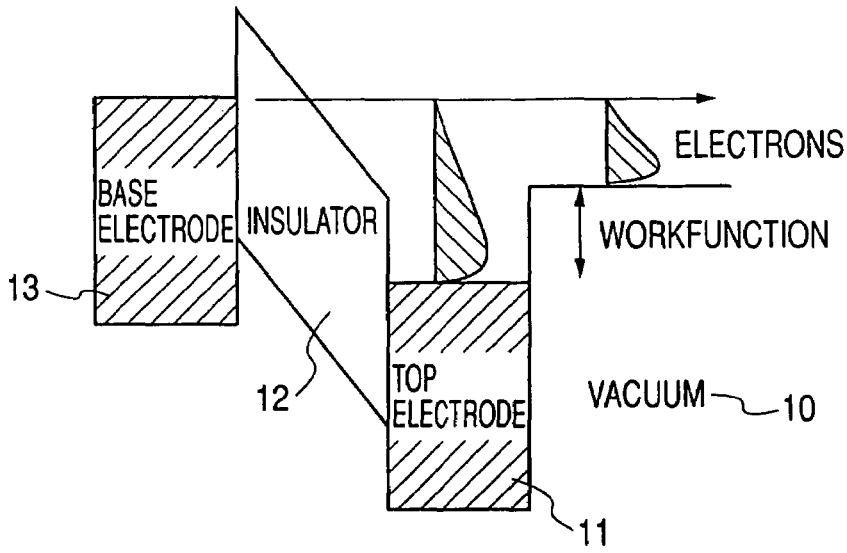
FIG. 13 Prior Art
FIG. 13 is a diagram for describing the principle of operation of a thin-film electron emitter.
Figure 14:
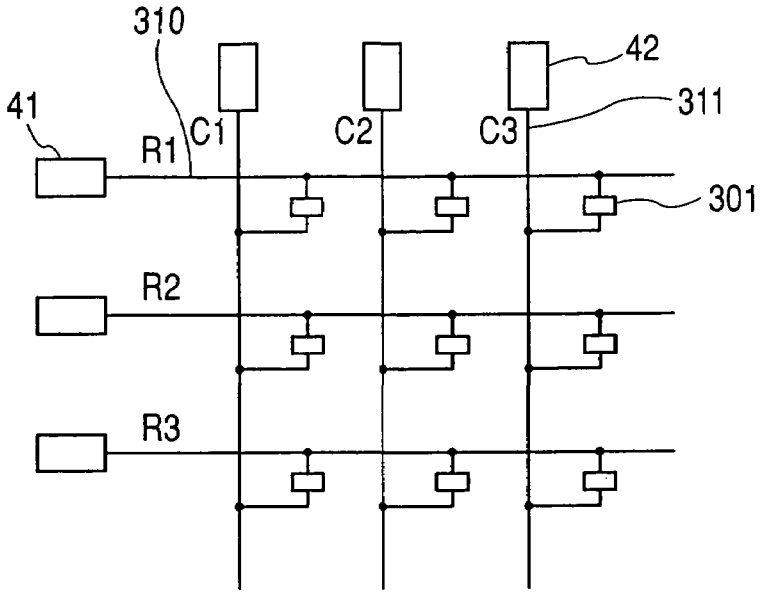
FIG. 14 Prior Art
FIG. 14 is a diagram showing a schematic configuration of a conventional thin-film electron-emitter matrix.
Figure 15:
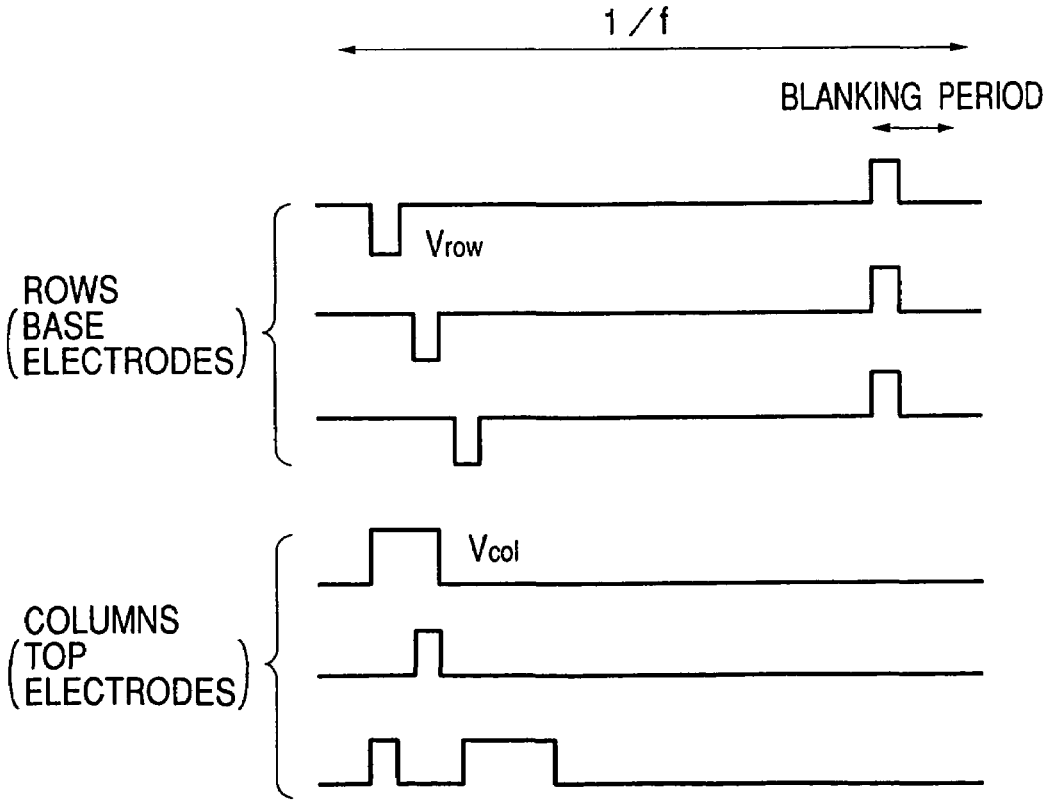
FIG. 15 Prior Art
FIG. 15 is a diagram for describing a conventional method of driving a display apparatus.

FIG. 12 is a timing chart showing one example illustrative of waveforms of driving voltages outputted from row electrode driving circuits 41 and column electrode driving circuits 42 employed in the image display according to the embodiment 2 of the present invention.

Incidentally, an acceleration voltage source 43 always applies an acceleration voltage of about 3KV to about 6KV to a metal back film 122 even in the case of the present embodiment.

In FIG. 12, dotted lines indicate high-impedance outputs respectively.

In fact, the output impedance may be set so as to range from about 1 Mω to about 10 Mω. In the present embodiment, it was set to 5Mω.

Let's now assume that in a manner similar to the embodiment 1, an nth row electrode 310 is represented as Rn, an mth column electrode 311 is represented as Cm, and a dot for an intersection of the nth row electrode 310 and the mth column electrode 311 is represented as (n, m).

At a time t0, any electrode carries a voltage of 0 and hence no electrons are emitted, whereby phosphors (114A through 114C) do not emit light.

At a time t1, the row electrode driving circuit 41 applies a driving voltage of ($V_{R1}$) to its corresponding row electrode 310 of R1, and the column electrode driving circuits 42 apply a driving voltage of ($V_{C1}$) to their corresponding column electrodes 311 of (C1 and C2).

Since a voltage of ($V_{C1}$-$V_{R1}$) is applied between a top electrode 11 and a base electrode 13 for dots (1, 1) and (1, 2), thin-film electron emitters for the two dots emit electrons into vacuum if the voltage of ($V_{C1}$-$V_{R1}$) is set to greater than or equal to a threshold voltage for electron emission.

In the present embodiment, $V_{R1}$=−5V and $V_{C1}$=4.5V.

The emitted electrons are accelerated under the voltage applied to the metal back film 112 and thereafter collide with the phosphors (114A through 114C) to thereby allow the phosphors (114A through 114C) to emit light.

Since the row electrodes 310 of others (R2 and R3) are respectively held in a high-impedance state during this period, no electrons are emitted regardless of the voltage values of the column electrodes 311, and hence the corresponding phosphors (114A through 114C) do not emit light either.

Since the column electrode 311 of C3 is held in the high-impedance state during this period, no electrons are emitted from a dot (1, 3) and hence the corresponding phosphors (114A through 114C) do not emit light either.

When the row electrode driving circuit 41 applies the driving voltage of ($V_{R1}$) to its corresponding row electrode 310 of R2, and the column electrode driving circuit 42 applies the voltage of ($V_{C1}$) to its corresponding column electrode 311 of C1 at a time t2, a dot (2, 1) lights up similarly.

When the driving voltages having such voltage waveforms as shown in FIG. 12 are now applied to their corresponding row and column electrodes 310 and 311, only dots diagonally shaded in FIG. 10 light up.

In this way, changing the signals applied to the column electrodes 311 allows the display of a desired image or information.

By suitably changing a pulse width of the driving voltage ($V_{C1}$) applied to each column electrode 311 in accordance with an image signal, an image having a gray scale can be displayed.

In order to release the charges accumulated in a tunneling insulator 12, the row electrode driving circuits 41 apply a driving voltage of ($V_{R2}$) to all of the row electrodes 310 and simultaneously the column electrode driving circuits 42 apply a driving voltage of 0V to all of the column electrodes at a time t4 in FIG. 12.

Since $V_{R2}$=5V now, a voltage of a −$V_{R2}$=−5V is applied to each thin-film electron emitter 301.

Applying the voltage (reverse pulse) of polarity opposite to upon electron emission in this way allows an improvement in lifetime characteristic of each thin-film electron emitter.

Incidentally, the use of a vertical blanking period of a video signal as reverse pulse applying periods (see t4 to t5 and t8 to t9 in FIG. 12) yields satisfactory matching with the video signal.

Since the column electrodes 311 each held in a non-selected state are also set to the high-impedance state as well as the row electrodes 310 each held in a non-selected state in the present embodiment as described above, power consumption can further be reduced as compared with the embodiment 1 as mentioned previously.

While the invention made by the present inventors has been described specifically by the illustrated embodiments, the present invention is not limited to the embodiments. It is needless to say that various changes can be made thereto within the scope not departing from the substance thereof.

An image display and a driving method thereof according to the present invention, particularly, a display apparatus using thin-film electron emitters for respectively emitting electrons into vacuum is intended for the implementation of a technology capable of reducing dissipation power incident to the driving of a thin-film electron emitter array and thereby reducing power consumption. This can provide great industrial applicability.

What is claimed is:

1. An image display comprising:

a display device including, a first plate having, a plurality of electron-emitter elements each having a structure comprised of a base electrode, an insulating layer and a top electrode stacked on one another in this order, said electron-emitter element emitting electrons from the surface of the top electrode when a voltage of positive polarity is applied to the top electrode;

a plurality of first electrodes extending in a row (or column) direction for respectively applying driving voltages to the base electrodes of the electron-emitter elements lying in the row (or column) direction, of said plurality of electron-emitter elements, a part of each of the first electrodes forming said base electrode; and a plurality of second electrodes extending in a column (or row) direction for respectively applying driving voltages to the top electrodes of the electron-emitter elements lying in the column (or row) direction, of said plurality of electron-emitter elements;

a frame component; and a second plate having phosphors;

wherein a space surrounded by said first plate, said frame component and said second plate is brought into vacuum;

first driving means for supplying driving voltages to said respective first electrodes; and second driving means for supplying driving voltages to said respective second electrodes;

wherein said first driving means sets the first electrode held in a non-selected state to a state of having an impedance higher than that of the first electrode held in a selected state, and wherein said second driving means sets the second electrode held in a non-selected state to a state of having an impedance higher than that of the second electrode held in a selected state.

2. An image display according to claim 1, wherein said high impedance is an impedance of 1 Mω or more.

3. An image display according to claim 1, wherein said first driving means brings a first electrode held in a non-selected state to a floating state.

4. An image display according to claim 1, wherein said second driving means brings a second electrode held in a non-selected state to a floating state.

5. An image display according to claim 1, wherein said each electron-emitter element includes a top electrode bus-line which is electrically connected to the top electrode and functions as the second electrode.

6. An image display according to claim 1, wherein said first electrode functions as the base electrode of said each electron-emitter element.

7. An image display according to claim 1, wherein said base electrode comprises a metal.

8. An image display according to claim 1, wherein said base electrode comprises a semiconductor.

9. An image display according to claim 1, wherein said insulating layer comprises a multi-layer film of a semiconductor and an insulator.

10. A driving method of an image display comprising:

providing an image display having:

a first plate having, a plurality of electron-emitter elements each having a structure comprised of a base electrode, an insulating layer and a top electrode stacked on one another in this order, said electron-emitter element emitting electrons from the surface of the top electrode when a voltage of positive polarity is applied to the top electrode;

a plurality of first electrodes extending in a row (or column) direction for respectively applying driving voltages to the base electrodes of the electron-emitter elements lying in the row (or column) direction, of said plurality of electron-emitter elements, a part of each of the first electrodes forming said base electrode; and a plurality of second electrodes extending in a column (or row) direction for respectively applying driving voltages to the top electrodes of the electron-emitter elements lying in the column (or row) direction, of said plurality of electron-emitter elements;

a frame component; and a second plate having phosphors;

wherein a space surrounded by said first plate, said frame component and said second plate is brought into vacuum;

setting the first electrode held in a non-selected state to a state of having an impedance higher than that of the first electrode held in a selected state; and setting the second electrode held in a non-selected state to a state of having an impedance higher than that of the second electrode held in a selected state.

11. A driving method according to claim 10, wherein said high impedance is an impedance of 1Mω or more.

12. A driving method according to claim 10, further including the step of bringing the first electrode held in the non-selected state to a floating state.

13. A driving method according to claim 10, further including the step of bringing the second electrode held in the non-selected state to a floating state.

14. An image display comprising:

a display device including, a first plate having, a plurality of thin-film electron emitters each having a base electrode and a top electrode, said each thin-film electron emitter emitting electrons from the surface of the top electrode when a voltage of positive polarity is applied to the top electrode;

a plurality of first electrodes extending in a row (or column) direction for respectively applying driving voltages to the base electrodes of the thin-film electron emitters lying in the row (or column) direction, of said plurality of thin-film electron emitters, a part of each of the first electrodes forming said base electrode; and a plurality of second electrodes extending in a column (or row) direction for respectively applying driving voltages to the top electrodes of the thin-film electron emitters lying in the column (or row) direction, of said plurality of thin-film electron emitters;

a frame component; and a second plate having phosphors;

wherein a space surrounded by said first plate, said frame component and said second plate is brought into vacuum;

first driving means for supplying driving voltages to said respective first electrodes; and second driving means for supplying driving voltages to said respective second electrodes;

wherein said first driving means sets the first electrode held in a non-selected state to a state of having an impedance higher than that of the first electrode held in a selected state, and wherein said second driving means sets the second electrode held in a non-selected state to a state of having an impedance higher than that of the second electrode held in a selected state.

* * * * *